US009276384B2

(12) United States Patent
Kobayashi

(10) Patent No.: US 9,276,384 B2
(45) Date of Patent: Mar. 1, 2016

(54) SPARK PLUG

(71) Applicant: NGK SPARK PLUG CO., LTD., Nagoya-shi, Aichi (JP)

(72) Inventor: Tsutomu Kobayashi, Aichi (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 0 days.

(21) Appl. No.: 14/437,663

(22) PCT Filed: Jun. 13, 2013

(86) PCT No.: PCT/JP2013/003713

§ 371 (c)(1),
(2) Date: Apr. 22, 2015

(87) PCT Pub. No.: WO2014/068809

PCT Pub. Date: May 8, 2014

(65) Prior Publication Data

US 2015/0295388 A1 Oct. 15, 2015

(30) Foreign Application Priority Data

Nov. 1, 2012 (JP) ..... 2012-241478

(51) Int. Cl.
*H01T 13/16* (2006.01)
*H01T 13/36* (2006.01)
*H01T 13/20* (2006.01)

(52) U.S. Cl.
CPC ..... *H01T 13/36* (2013.01); *H01T 13/16* (2013.01)

(58) Field of Classification Search
None
See application file for complete search history.

(56) References Cited

U.S. PATENT DOCUMENTS

| | | | | |
|---|---|---|---|---|
| 2007/0126330 | A1 | 6/2007 | Kuki et al. | 313/143 |
| 2008/0061670 | A1 | 3/2008 | Nakayama et al. | 313/143 |
| 2012/0153801 | A1* | 6/2012 | Kato | H01T 13/12 313/143 |
| 2013/0134857 | A1 | 5/2013 | Shimamura et al. | 313/135 |
| 2015/0188294 | A1* | 7/2015 | Nishida | H01B 3/12 174/110 R |

FOREIGN PATENT DOCUMENTS

| | | | |
|---|---|---|---|
| JP | 2005-183177 A | 7/2005 | H01T 13/36 |
| JP | 2007-250344 A | 9/2007 | H01T 13/20 |
| JP | 2008-91322 A | 4/2008 | H01T 13/08 |
| JP | 2013-114762 A | 6/2013 | H01T 13/20 |

OTHER PUBLICATIONS

Search report issued in corresponding International Patent Application No. PCT/JP2013/003713, dated Jul. 30, 2013.

* cited by examiner

*Primary Examiner* — Ashok Patel
(74) *Attorney, Agent, or Firm* — Kusner & Jaffe

(57) ABSTRACT

An ignition plug includes a tubular ceramic insulator and a metallic shell having a protrusion protruding radially inward. The ceramic insulator has an engagement portion which is engaged with a receiving surface of the protrusion and an intermediate trunk portion extending rearward from the rear end of the engagement portion. A≤1.70 and B ≥1.20 are satisfied, where A is the thickness (mm) of the metallic shell along a direction which passes through the center of the receiving surface and is orthogonal to the axial line on a cross section including the axial line, and B is the minimum thickness (mm) of the metallic shell 3 at the tube portion along the direction orthogonal to the axial line.

5 Claims, 4 Drawing Sheets

SPARK PLUG

RELATED APPLICATIONS

This application is a National Stage of International Application No. PCT/JP2013/003713 filed Jun. 13, 2013, which claims the benefit of Japanese Patent Application No. 2012-241478, filed Nov. 1, 2012.

FIELD OF THE INVENTION

The present invention relates to an ignition plug used for an internal combustion engine or the like.

BACKGROUND OF THE INVENTION

In general, an ignition plug includes an insulator having an axial hole extending in an axial line, a center electrode inserted in a forward end portion of the axial hole, a metallic shell provided around the insulator, and a ground electrode providing at a forward end portion of the metallic shell and forming a spark discharge gap in cooperation with the center electrode. When a predetermined voltage is applied to the spark discharge gap, spark discharge occurs at the spark discharge gap, whereby an air-fuel mixture or the like is ignited.

The insulator has a leg portion which is formed at the forward end and has a relatively small diameter, and a tapered engagement portion provided adjacent to the rear end of the leg portion. The metallic shell has, on its outer circumference, a screw portion used for attaching the ignition plug to an internal combustion engine or the like. A flange-shaped seating portion is formed on the rear end side of the screw portion, and a cylindrical tube portion (screw neck) is formed between the screw portion and the seating portion. In addition, the metallic shell has a protrusion which protrudes from its inner circumferential surface toward the radially inner side. The metallic shell and the insulator are fixed together in a state in which the engagement portion of the insulator is engaged with the protrusion of the metallic shell directly or indirectly via a sheet packing or the like (see, for example, Japanese Patent Application Laid-Open (kokai) No. 2005-183177). Notably, the heat exerted on forward end portions of the leg portion and the center electrode as a result of combustion of an air-fuel mixture or the like is mainly conducted to the engagement portion through the leg portion and the center electrode, and is conducted from the engagement portion to the protrusion.

In recent years, a reduction in the diameter of an ignition plug (metallic shell) has been demanded in order to increase the degree of freedom of the engine layout or for other reasons. In such an ignition plug having a reduced diameter, the outer diameters (volumes) of the insulator and the center electrode disposed inside the metallic shell must be decreased. Therefore, the heat conduction path becomes narrow, and the heat conduction performance may deteriorate. If the heat conduction performance deteriorates, the leg portion and the center electrode are overheated, which may lead to, for example, a decrease in the yield strength of the insulator (leg portion), generation of pre-ignition in which a forward end portion of the insulator (leg portion) serves as a heat source, and rapid erosion and deformation of the center electrode. One possible measure for preventing the overheating of the insulator and the center electrode is decreasing the thickness of the metallic shell so as to increase the inner diameter of the metallic shell to thereby increase the outer diameters (volumes) of the insulator, etc.

However, in the case where the thickness of the metallic shell is merely reduced, when a tightening torque is applied to the metallic shell in order to screw the screw portion into an internal combustion engine or the like, the metallic shell may break at a tube portion thereof.

The present invention has been accomplished in view of the above-described problem, and its advantage is an ignition plug which can effectively enhance the heat conduction performances of an insulator and a center electrode to thereby suppress overheating of the insulator, etc., while preventing breakage of a tube portion of a metallic shell more reliably.

SUMMARY OF THE INVENTION

Configurations suitable for achieving the above advantage will next be described in itemized form. If needed, actions and effects peculiar to the configurations will be additionally described.

Configuration 1. In accordance with a first aspect of the present invention, there is provided an ignition plug of the present configuration that comprises:

a tubular insulator having an axial hole extending in a direction of an axial line;

a center electrode inserted into a forward end portion of the axial hole; and a metallic shell provided around the insulator and having a protrusion protruding radially inward, wherein the insulator has an engagement portion which is engaged directly or indirectly with a receiving surface of the protrusion which is a rear-end-side surface thereof, and an intermediate trunk portion extending rearward from a rear end of the engagement portion, and the metallic shell has, on its outer circumference, an attachment screw portion located on a radially outer side of the protrusion, a seating portion located rearward of the screw portion and projecting radially outward, and a tube portion located between the screw portion and the seating portion, the tube portion being located on the radially outer side of the intermediate trunk portion and having a diameter smaller than that of the seating portion, wherein the screw portion has a screw diameter of 10 mm or less; and a relation $A \leq 1.70$ and a relation $B \geq 1.20$ are satisfied, where A is a thickness (mm) of the metallic shell along a direction which passes through a center of the receiving surface and is orthogonal to the axial line on a cross section including the axial line, and B is a minimum thickness (mm) of the metallic shell at the tube portion along the direction orthogonal to the axial line.

Notably, the "thickness of the metallic shell along a direction which passes through a center of the receiving surface and is orthogonal to the axial line" is half a value obtained by subtracting the inner diameter of the metallic shell at the center of the receiving surface from the pitch diameter of the screw portion.

The heat conducted from the engagement portion of the insulator to the protrusion is conducted, through the metallic shell, to an apparatus (for example, an internal combustion engine or the like) to which the ignition plug is attached. Since heat conduction to the apparatus occurs quickly, the heat exerted on the insulator and the center electrode is quickly conducted to the metallic shell, etc.

According to the above-described configuration 1, the thickness A which corresponds to the length of a heat conduction path through which the heat conducted from the engagement portion of the insulator to the protrusion flows to the above-mentioned apparatus is set to 1.70 mm or less.

Accordingly, the heat conducted from the engagement portion to the protrusion can be conducted to the above-mentioned apparatus efficiently. As a result, the heat exerted on the forward end portions of the insulator and the center electrode can be quickly conducted, whereby overheating of the insulator and the center electrode can be prevented more reliably.

Also, according to the above-described configuration 1, although the screw diameter of the screw portion is 10 mm or less, the thickness A is 1.70 mm or less. Therefore, the metallic shell can have a relatively large inner diameter. Thus, the outer diameters (volumes) of the insulator, etc. disposed inside the metallic shell can be increased, whereby the conduction paths for the heat flowing through the insulator, etc. can be widened. As a result, the heat of the insulator, etc. can be conducted to the above-mentioned apparatus more quickly, whereby the effect of preventing overheating of the insulator, etc. can be enhanced.

In the case where the thickness A is set to 1.70 mm or less, there is fear of the tube portion breaking when the ignition plug is attached to the above-mentioned apparatus.

However, according to the above-described configuration, the thickness B of the metallic shell at the tube portion is set to 1.20 mm or greater. Accordingly, the mechanical strength of the tube portion can be increased sufficiently, whereby breakage of the tube portion can be prevented more reliably.

As described above, according to the above-described configuration 1, the relation $A \leq 1.70$ mm and the relation $B \geq 1.20$ mm are satisfied. Therefore, it is possible to effectively enhance the heat conduction performances of the insulator and the center electrode, while preventing breakage of the tube portion more reliably.

Configuration 2. In accordance with a second aspect of the present invention, there is provided an ignition plug as characterized in configuration 1 mentioned above, wherein the protrusion has a straight surface extending forward from a forward end of the receiving surface and having a fixed inner diameter; and a relation $C \geq A$ is satisfied, where C is a length (mm) of the straight surface along the axial line.

The heat conducted from the engagement portion to the protrusion is considered to be conducted, through the metallic shell, radially from the receiving surface of the protrusion. Heat conducts less to a portion of the metallic shell located outside a region which extends from the receiving surface and has an extension (length) equal to the thickness A. This is because, before heat flows to the portion located outside the region, a large part of the heat is conducted to the above-mentioned apparatus, which is closer to the receiving surface than is the portion outside the region. Meanwhile, a portion of the metallic shell located within the above-mentioned region is likely to become relatively high in temperature.

In consideration of this point, according to the above-described configuration 2, the ignition plug is configured to satisfy the relation $C \geq A$; i.e., configured such that the straight surface has a portion located outside the above-described region (namely, a portion which is prevented from becoming high in temperature due to the heat conducted from the engagement portion to the protrusion and which is likely to become relatively low in temperature). Accordingly, the quantity of heat conducted from the insulator to the straight surface can be increased remarkably, whereby the heat conduction performances of the insulator, etc. can be enhanced further.

Configuration 3. In accordance with a third aspect of the present invention, there is provided an ignition plug as characterized in configuration 1 or 2 mentioned above, wherein the protrusion has a straight surface extending forward from a forward end of the receiving surface and having a fixed inner diameter; and a distance between the straight surface and an outer circumferential surface of the insulator is 0.22 mm or less within a region having an extension of 1.66 mm or greater in the direction of the axial line.

Notably, the expression "the straight surface having a fixed inner diameter" encompasses not only a straight surface having a strictly fixed inner diameter but also a straight surface which has a small inclination (e.g., the acute angle formed between the outline of the straight surface and the axial line on a cross section including the axial line is 10° or less) and whose inner diameter changes slightly (this applies to the following description).

According to the above-described configuration 3, the straight surface has a portion where the distance between the straight surface and the outer circumferential surface of the insulator is 0.22 mm or less and heat conducts from the insulator to the straight surface very easily, and the length of that portion is set to 1.66 mm or more. Accordingly, the quantity of heat conducted from the insulator to the straight surface can be increased further, whereby the heat conduction performance can be enhanced further.

Configuration 4. In accordance with a fourth aspect of the present invention, there is provided an ignition plug as characterized in any of configurations 1 to 3 mentioned above, wherein the protrusion has a tapered forward-end-side surface whose diameter decreases toward the forward end side in the direction of the axial line; and a relation $\theta \geq 60$ is satisfied, where $\theta$ is an acute angle (°) formed between an outline of the forward-end-side surface and a straight line perpendicularly intersecting the axial line on the cross section including the axial line.

According to the above-described configuration 4, a large area of the forward-end-side surface can be made close to the insulator. Accordingly, the heat of the insulator can be conducted to the forward-end-side surface more efficiently, whereby the heat conduction performance can be enhanced further.

DETAILED DESCRIPTION OF THE PREFERRED EMBODIMENTS

Figure 1:
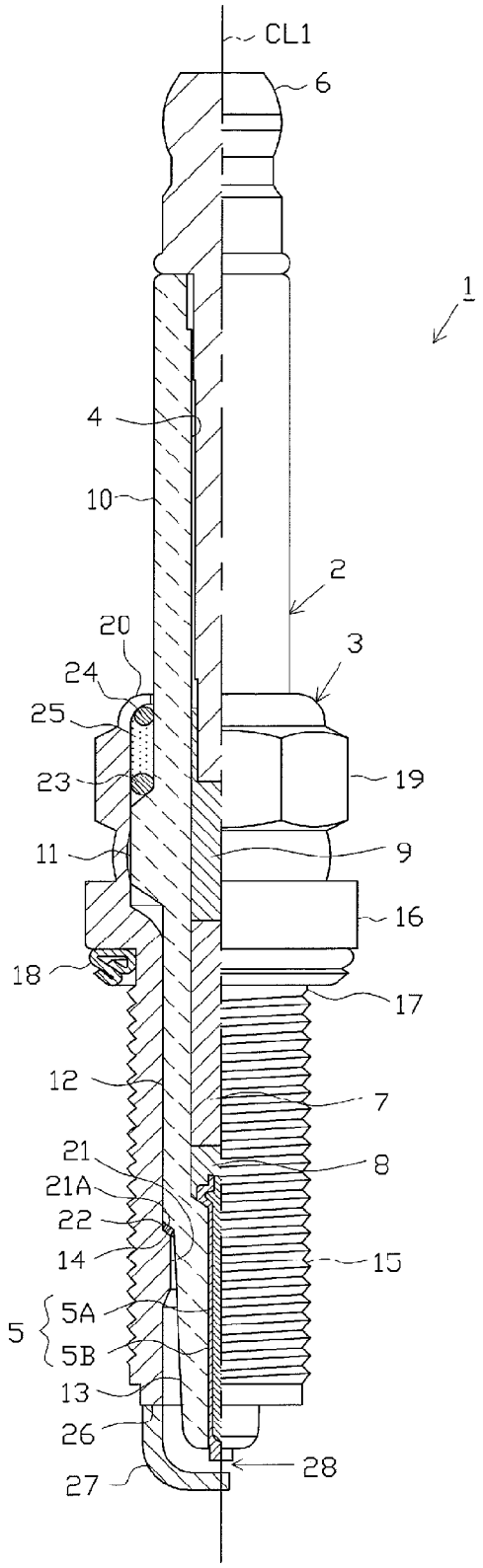
FIG. 1 is a partially sectioned front view showing the structure of an ignition plug.

One embodiment will next be described with reference to the drawings. FIG. 1 is a partially sectioned front view showing an ignition plug 1. In the following description, the direction of an axial line CL1 of the ignition plug 1 in FIG. 1 is referred to as the vertical direction, and the lower side of the ignition plug 1 in FIG. 1 is referred to as the forward end side of the ignition plug 1, and the upper side as the rear end side of the ignition plug 1.

The ignition plug 1 includes a tubular ceramic insulator 2 and a tubular metallic shell 3, which holds the ceramic insulator 2.

The ceramic insulator 2 is formed from alumina or the like by firing, as well known in the art. The ceramic insulator 2 includes, on its outer circumference, a rear trunk portion 10 formed on the rear end side; a large-diameter portion 11, which is located forward of the rear trunk portion 10 and projects radially outward; an intermediate trunk portion 12, which is located forward of the large-diameter portion 11 and is smaller in diameter than the large-diameter portion 11; and a leg portion 13, which is located forward of the intermediate trunk portion 12 and is smaller in diameter than the intermediate trunk portion 12. Of the ceramic insulator 2, the large-diameter portion 11, the intermediate trunk portion 12, and most of the leg portion 13 are accommodated in the metallic shell 3. A tapered engagement portion 14 is formed between the intermediate trunk portion 12 and the leg portion 13 such that its diameter decreases toward the forward end side. The intermediate trunk portion 12 extends from the rear end of the engagement portion 14 toward the rear end side. The ceramic insulator 2 is engaged with the metallic shell 3 via the engagement portion 14.

The ceramic insulator 2 has an axial hole 4 extending therethrough in the direction of the axial line CL1. A center electrode 5 is fixedly inserted into a forward end portion of the axial hole 4. The center electrode 5 includes an inner layer 5A and an outer layer 5B. The inner layer 5A is formed of a metal which is excellent in thermal conductivity (e.g., copper, copper alloy, pure nickel (Ni) or the like). The outer layer 5B is formed of an alloy which contains Ni as a main component. The center electrode 5 assumes a rodlike (circular columnar) shape as a whole, and a forward end portion of the center electrode 5 projects from the forward end of the ceramic insulator 2.

A terminal electrode 6 is fixedly inserted into a rear end portion of the axial hole 4 and projects from the rear end of the ceramic insulator 2.

A circular columnar resistor 7 is disposed within the axial hole 4 between the center electrode 5 and the terminal electrode 6. Opposite end portions of the resistor 7 are electrically connected to the center electrode 5 and the terminal electrode 6 via electrically conductive glass seal layers 8 and 9, respectively.

The metallic shell 3 is formed of a metal such as low-carbon steel (e.g., S25C or the like) and has a tubular shape. The metallic shell 3 has a screw portion (externally threaded portion) 15 on its outer circumferential surface. The screw portion 15 is used to attach the ignition plug 1 to a predetermined apparatus (e.g., an internal combustion engine, a fuel cell reformer, or the like). A seating portion 16 projecting radially outward is formed on the outer circumferential surface and located rearward of the screw portion 15. A cylindrical tube portion 17 is formed between the screw portion 15 and the seating portion 16. The tube portion 17 is located on the radially outward side of the intermediate trunk portion 12. A ring-like gasket 18 is fitted on the outer circumference of the tube portion 17. The metallic shell 3 also has a tool engagement portion 19 provided near its rear end. The tool engagement portion 19 has a hexagonal cross section and allows a tool such as a wrench to be engaged therewith when the metallic shell 3 is to be mounted to the above-mentioned apparatus. Further, the metallic shell 3 has a crimp portion 20 provided at its rear end portion and bent radially inward. In the present embodiment, in order to reduce the size (diameter) of the ignition plug 1, the diameter of the metallic shell 3 is decreased, and the screw portion 15 has a screw diameter of 10 mm or less.

The metallic shell 3 has an annular protrusion 21 provided on its inner circumferential surface. The protrusion 21 protrudes radially inward and has its center on the axial line CL1. The ceramic insulator 2 is inserted forward into the metallic shell 3 from the rear end of the metallic shell 3. In a state in which the engagement portion 14 of the ceramic insulator 2 butts against a receiving surface 21A which is a rear-end-side surface of the protrusion 21 with an annular sheet packing 22 being interposed therebetween, a rear-end opening portion of the metallic shell 3 is crimped radially inward; i.e., the crimp portion 20 is formed, whereby the ceramic insulator 2 is fixed to the metallic shell 3. The sheet packing 22 provided between the engagement portion 14 and the receiving portion 21A retains gastightness of a combustion chamber and prevents leakage of a fuel gas to the exterior of the ignition plug 1 through a clearance between the inner circumferential surface of the metallic shell 3 and the leg portion 13 of the ceramic insulator 2, which leg portion 13 is exposed to the combustion chamber.

In order to make more perfect the gastightness established by crimping, annular ring members 23 and 24 are provided between the metallic shell 3 and the ceramic insulator 2 in a region near the rear end of the metallic shell 3, and a space between the ring members 23 and 24 is filled with powder of talc 25. That is, the metallic shell 3 holds the ceramic insulator 2 via the sheet packing 22, the ring members 23 and 24, and the talc 25.

A ground electrode 27 is joined to a forward end portion 26 of the metallic shell 3. The ground electrode 27 is bent, at its intermediate portion, such that a side surface of a distal end portion of the ground electrode 27 faces a forward end portion of the center electrode 5. A spark discharge gap 28 is formed between the forward end portion of the center electrode 5 and the distal end portion of the ground electrode 27. Spark discharge occurs at the spark discharge gap 28 in a direction parallel to the axial line CL1.

Incidentally, in the case where the screw diameter of the screw portion 15 is relatively small, in general, the outer diameters of the leg portion 13 and the center electrode 5 must be decreased. However, when the outer diameters of the leg portion 13 and the center electrode 5 are decreased, paths through which the heat exerted on forward end portions of the leg portion 13 and the center electrode 5 are conducted to the metallic shell 3 become narrower. Therefore, the leg portion 13 and the center electrode 5 are overheated, which may result in a decrease in in the yield strength of the ceramic insulator 2 (leg portion 13 ), generation of pre-ignition in which a forward end portion of the ceramic insulator 2 (leg portion 13 ) serves as a heat source, and rapid erosion and deformation of the center electrode 5.

Figure 2A:
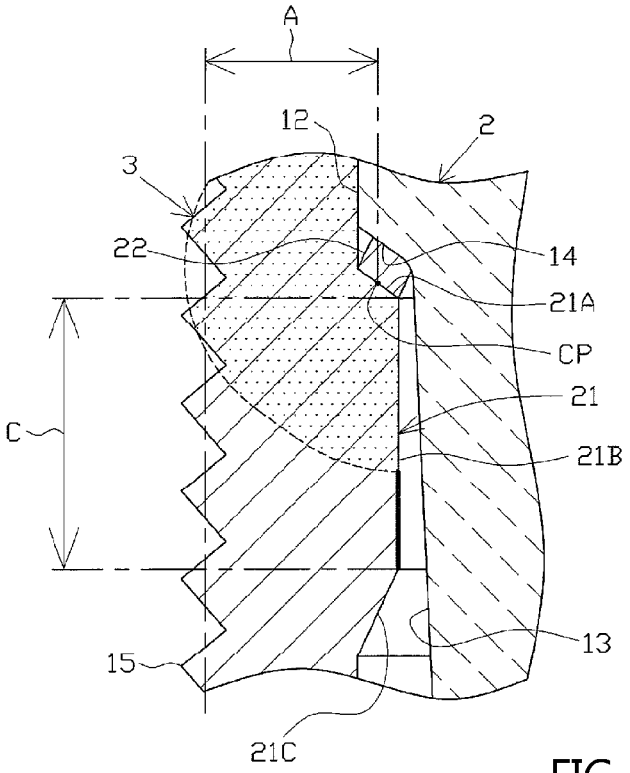
FIG. 2(*a*) is an enlarged sectional view of a portion of the metallic shell with which a ceramic insulator is engaged, and FIG. 2(*b*) is an enlarged sectional view of a tube portion, etc.
Figure 2B:
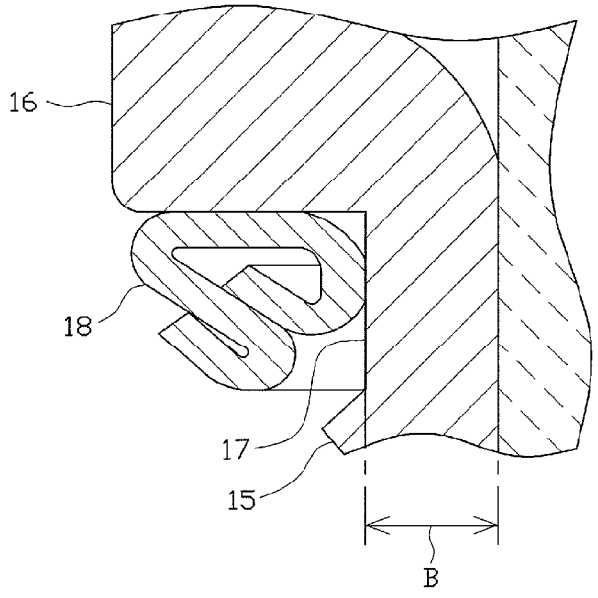

In view of this, the ignition plug 1 of the present embodiment is configured to satisfy a relation $A \leq 1.70$. As shown in FIG. 2(*a*), A is the thickness (mm) of the metallic shell 3 measured along a direction which passes through the center CP of the receiving surface 21A and is orthogonal to the axial line CL1. Namely, since the wall thickness of the metallic shell 3 is relatively small, heat is quickly conducted from the ceramic insulator 2, etc. to the above-mentioned apparatus through the metallic shell 3. Also, since the wall thickness of the metallic shell 3 is decreased, it becomes possible to increase the outer diameters (volumes) of the leg portion 13 and the center electrode 5 (namely, enhance the heat conduction performances of the leg portion 13 and the center electrode 5). Notably, the thickness A is half a value obtained by subtracting the inner diameter of the metallic shell 3 at the center CP from the pitch diameter of the screw portion 15.

Meanwhile, when the wall thickness of the metallic shell 3 is reduced excessively, the mechanical strength of the tube portion 17 becomes insufficient. In such case, when a tightening torque is applied to the tool engagement portion 19 in order to attach the ignition plug 1 to the above-mentioned apparatus, the metallic shell 3 may break at the tube portion 17 located between the screw portion 15 and the tool engagement portion 19.

In order to overcome such a drawback, in the present embodiment, the ignition plug 1 is configured to satisfy a relation B≥1.20 . As shown in FIG. 2(*b*), B is the minimum thickness (mm) of the metallic shell 3 at the tube portion 17 measured in a direction orthogonal to the axial line CL1. Namely, the ignition plug 1 is configured such that the tube portion 17 has a sufficient mechanical strength.

Further, as shown in FIG. 2(*a*), the protrusion 21 has a straight surface 21B which extends forward from the forward end of the receiving surface 21A and which has a fixed inner diameter. The distance between the straight surface 21B and the outer circumferential surface of the leg portion 13 is made relatively small (e.g., 0.5 mm or less). Therefore, the heat exerted on the leg portion 13 and the center electrode 5 is conducted to the metallic shell 3 not only through the sheet packing 22 but also the space between the straight surface 21B and the leg portion 13. The expression "the straight surface 21B has a fixed inner diameter" encompasses not only the case where the straight surface 21B has a strictly fixed inner diameter but also the case where the straight surface 21B has a small inclination (e.g., the acute angle formed between the outline of the straight surface 21B and the axial line CL1 on a cross section including the axial line CL1 is 10° or less), and the inner diameter changes slightly.

Also, the ignition plug 1 of the present embodiment is configured to satisfy a relation C≥A. C is the length (mm) of the straight surface 21B measured along the axial line CL1. Namely, due to the heat conducted to the protrusion 21 through the sheet packing 22, a portion (a dotted portion in FIG. 2(*a*)) of the metallic shell 3 which is located in a region extending from the receiving surface 21A and having an extension (length) equal to the thickness A is likely to become relatively high in temperature. In the present embodiment, the straight surface 21B is formed such that the relation C≥A is satisfied. Therefore, the straight surface 21B has a portion (a portion indicated by a thick line in FIG. 2(*a*)) which is prevented from becoming high in temperature due to the heat conducted to the protrusion 21 and is likely to become relatively low in temperature.

Figure 3:
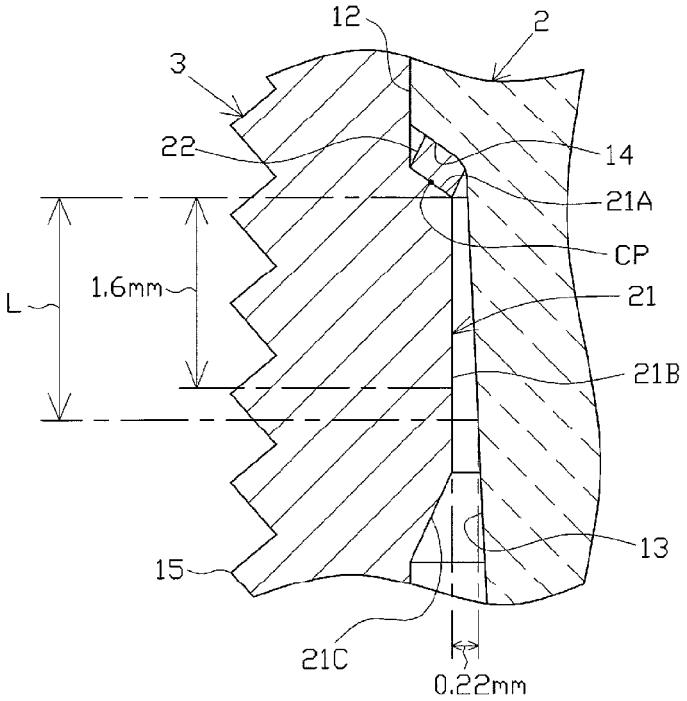
FIG. 3 is an enlarged sectional view of a portion of the metallic shell with which the ceramic insulator is engaged.

In addition, in the present embodiment, as shown in FIG. 3, in a region which extends 1.66 mm or more in the direction of the axial line CL1, the distance between the straight surface 21B and the outer circumferential surface of the ceramic insulator 2 (leg portion 13 ) is 0.22 mm or less. Namely, the straight surface 21B has a portion where the distance between the straight surface 21B and the leg portion 13 is 0.22 mm or less and heat conducts from the leg portion 13 to the straight surface 21B very easily, and the length L of that portion is rendered sufficiently large.

Figure 4:
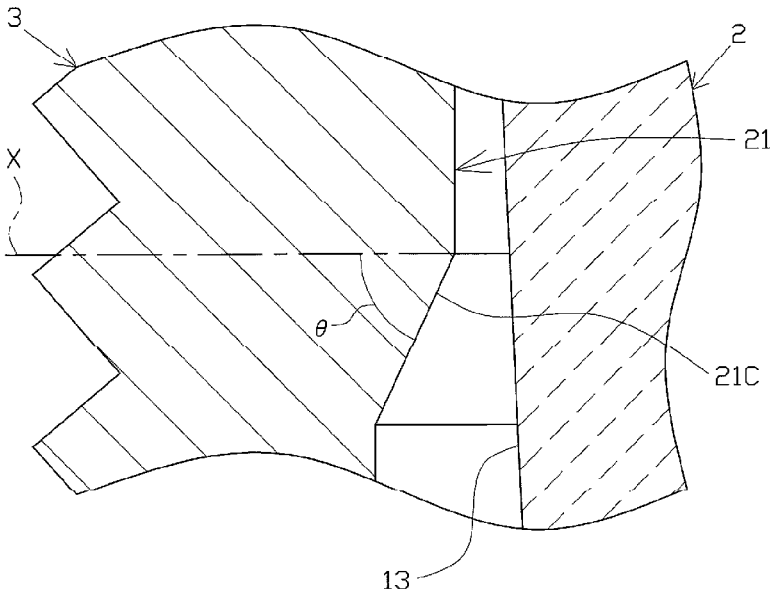
FIG. 4 is an enlarged sectional view showing the angle of a forward-end-side surface of a protrusion.

Moreover, as shown in FIG. 4, the protrusion 21 has a tapered forward-end-side surface 21C whose diameter decreases forward in the direction of the axial line CL1. The forward-end-side surface 21C is formed such that a relation θ≥60 is satisfied. θ is an acute angle)(°) formed between the outline of the forward-end-side surface 21C and a straight line X orthogonal to the axial line CL1 on a cross section including the axial line CL1. Notably, preferably, the angle θ is set to 80° or less.

As having been described in detail, according to the present embodiment, the thickness A of the metallic shell 3 is set to 1.70 mm or less. Therefore, the heat conducted from the engagement portion 14 to the protrusion 21 can be efficiently conducted to the above-mentioned apparatus. As a result, the heat exerted on the forward end portions of the ceramic insulator 2 and the center electrode 5 can be conducted quickly, whereby overheating of the ceramic insulator 2 and the center electrode 5 can be prevented more reliably.

In the present embodiment, although the screw diameter of the screw portion 15 is 10 mm or less, the metallic shell 3 can have a relatively large inner diameter because the thickness A is set to 1.70 mm or less. Thus, the outer diameters (volumes) of the ceramic insulator 2, etc. disposed inside the metallic shell 3 can be increased, whereby the conduction paths for the heat flowing through the ceramic insulator 2, etc. can be widened. As a result, the heat of the ceramic insulator 2, etc. can be conducted to the above-mentioned apparatus more quickly, whereby the effect of preventing overheating of the ceramic insulator 2, etc. can be enhanced.

In the present embodiment, the thickness B of the metallic shell 3 at the tube portion 17 is set to 1.20 mm or greater. Accordingly, the mechanical strength of the tube portion 17 can be increased sufficiently, whereby breakage of the tube portion 17 can be prevented more reliably.

Since the ignition plug 1 of the present embodiment is configured such that the relation C≥A is satisfied, and the straight surface 21B has a portion where the straight surface 21B is likely to become relatively low in temperature. Accordingly, the quantity of heat conducted from the ceramic insulator 2 to the straight surface 21B can be increased remarkably, whereby the heat conduction performances of the ceramic insulator 2, etc. can be enhanced further.

The length L of the region where the distance between the straight surface 21B and the outer circumferential surface of the ceramic insulator 2 (leg portion 13 ) is 0.22 mm or less is 1.66 mm or more as measured along the axial line CL1. Therefore, the quantity of heat conducted from the ceramic insulator 2 to the straight surface 21B can be increased further, whereby the heat conduction performance can be enhanced further.

Since the angle θ is set to 60° or more, a large area of the forward-end-side surface 21C can be made close to the ceramic insulator 2. Accordingly, the heat of the ceramic insulator 2 can be conducted to the forward-end-side surface 21C more efficiently, whereby the heat conduction performance can be enhanced further.

A heat conduction performance evaluation test was performed in order to confirm the action and effect achieved by the above-described embodiment. There were manufactured samples of the ignition plugs in which the thickness A (mm) of the metallic shell was set to different values by changing the inner diameter (first inner diameter; mm) of a portion of the metallic shell receiving the intermediate trunk portion and the minimum inner diameter (second inner diameter; mm) of the metallic shell at the protrusion. The heat conduction performance evaluation test was performed for each sample. The outline of the heat conduction performance evaluation test is as follows. Each sample was attached to a bush formed of metal, a forward end portion of the leg portion and a forward end portion of the center electrode were heated by a predetermined heat gun, and a time elapsed before the temperature of the tube portion reached 100° C. (100° C. reached time) was measured. For each sample, the ratio of the measured 100° C. reached time to the 100° C. reached time of a reference sample in which the thickness A was set to 1.78 mm (Sample 7 in Table 1 corresponding to an comparative example) was calculated as an improvement ratio. A sample whose improvement ratio was 0.92 or less was evaluated "good" because it is excellent in terms of the heat conduction performance of the ceramic insulator. A sample whose improvement ratio was greater than 0.92 but not greater than 1.00 was evaluated "acceptable" because it is slightly poor in terms of the heat conduction performance. A sample whose improvement ratio was greater than 1.00 was evaluated "unacceptable" because it is poor in terms of the heat conduction performance.

Table 1 shows the results of the test. Notably, in each sample, the screw diameter of the screw portion was set to 10 mm, and the length C of the straight surface was rendered smaller than the thickness A.

TABLE 1

| Sample No. | First inner diameter (mm) | Second inner diameter (mm) | Thickness A (mm) | 100° C. reached time (s) | Improvement ratio | Evaluation |
|---|---|---|---|---|---|---|
| 1 | 6.3 | 4.9 | 1.88 | 413 | 1.05 | Unacceptable |
| 2 | 6.3 | 5.1 | 1.83 | 401 | 1.02 | Unacceptable |
| 3 | 6.3 | 5.4 | 1.75 | 388 | 0.99 | Acceptable |
| 4 | 6.3 | 5.6 | 1.70 | 361 | 0.92 | Good |
| 5 | 6.3 | 5.8 | 1.65 | 352 | 0.90 | Good |
| 6 | 6.5 | 4.9 | 1.83 | 411 | 1.05 | Unacceptable |
| 7 | 6.5 | 5.1 | 1.78 | 393 | 1.00 | (Reference sample) |
| 8 | 6.5 | 5.4 | 1.70 | 360 | 0.92 | Good |
| 9 | 6.5 | 5.6 | 1.65 | 356 | 0.91 | Good |
| 10 | 6.5 | 5.8 | 1.60 | 348 | 0.89 | Good |
| 11 | 6.7 | 4.9 | 1.78 | 388 | 0.99 | Acceptable |
| 12 | 6.7 | 5.1 | 1.73 | 362 | 0.92 | Good |
| 13 | 6.7 | 5.4 | 1.65 | 357 | 0.91 | Good |
| 14 | 6.7 | 5.6 | 1.60 | 346 | 0.88 | Good |
| 15 | 6.7 | 5.8 | 155 | 340 | 0.87 | Good |

It was found that, as shown in Table 1, each of the samples in which the thickness A is set to 1.70 mm or less has a good heat conduction performance. Conceivably, such a good heat conduction performance is attained because the thickness A is set to 1.70 mm or less, and therefore, heat of the ceramic insulator, etc. is quickly conducted to the bush side.

Next, samples of the ignition plug in which the thickness B (mm) of the above-mentioned tube portion was set to different values by changing the above-mentioned first inner diameter were manufactured, and a tube portion strength test was performed for each sample. The outline of the tube portion strength test is as follows. Each sample was attached to a bush formed of iron by applying a tightening torque thereto from a predetermined screw tightening tester, and the application of the tightening torque was continued after the attachment. The tightening torque at which breakage occurred at the tube portion (breakage torque) was measured. A sample whose breakage torque was 25 N·m or greater was evaluated "good" because its tube portion had sufficient mechanical strength. A sample whose breakage torque was less than 25 N·m was evaluated "unacceptable" because the mechanical strength of the tube portion was insufficient.

Table 2 shows the results of the test. Notably, in each sample, the screw diameter of the screw portion was set to 10 mm, and the outer diameter of the tube portion was set to about 9 mm. The rotational speed at the time of attachment of each sample was set to 4 rpm.

TABLE 2

| First inner diameter (mm) | 6.2 | 6.3 | 6.4 | 6.5 | 6.6 | 6.7 | 6.8 |
|---|---|---|---|---|---|---|---|
| Thickness B (mm) | 1.45 | 1.40 | 1.35 | 1.30 | 1.25 | 1.20 | 1.15 |
| Evaluation | Good | Good | Good | Good | Good | Good | Unacceptable |

It was found that, as shown in Table 2, the samples in which the thickness B is set to 1.20 mm or greater have sufficient mechanical strength at the tube portion, and can prevent breakage of the tube portion more reliably.

The results of the above-described two tests reveal that, in order to effectively enhance the heat conduction performances of the ceramic insulator and the center electrode while preventing breakage of the tube portion, the ignition plug is preferably configured to satisfy the relation A≤1.70 mm and the relation B≥1.20 mm.

Next, samples of the ignition plug in which the length C of the straight surface was set to different values were manufactured, and the above-mentioned heat conduction performance evaluation test was performed for each sample. In this test, the thickness A was set to 1.70 mm or 1.65 mm. For the samples in which the thickness A was set to 1.70 mm, the improvement ratio of each sample was calculated with the 100° C. reached time of Sample 8 in Table 1 (having the same structure as Sample 22 in Table 3) used as a reference. For the samples in which the thickness A was set to 1.65 mm, the improvement ratio of each sample was calculated with the 100° C. reached time of Sample 9 in Table 1 (having the same structure as Sample 27 in Table 4) used as a reference. A sample whose improvement ratio was 0.95 or less was evaluated "good" because it can enhance the heat conduction performance effectively. A sample whose improvement ratio was greater than 0.95 but not greater than 1.00 was evaluated "acceptable" because its heat conduction performance enhancing effect is slightly low. A sample whose improvement ratio was greater than 1.00 was evaluated "unacceptable" because its heat conduction performance enhancing effect is poor. Table 3 shows the test results of the samples in which the thickness A was set to 1.70 mm, and Table 4 shows the test results of the samples in which the thickness A was set to 1.65 mm.

TABLE 3

| Sample No. | Thickness A (mm) | Length C (mm) | C/A | 100° C. reached time (s) | Improvement ratio | Evaluation |
|---|---|---|---|---|---|---|
| 20 | 1.70 | 1.05 | 0.618 | 388 | 1.08 | Unacceptable |
| 21 | 1.70 | 1.25 | 0.735 | 381 | 1.06 | Unacceptable |
| 22 | 1.70 | 1.45 | 0.853 | 360 | 1.00 | (Reference sample) |
| 23 | 1.70 | 1.65 | 0.971 | 352 | 0.98 | Acceptable |
| 24 | 1.70 | 1.85 | 1.088 | 332 | 0.92 | Good |

TABLE 4

| Sample No. | Thickness A (mm) | Length C (mm) | C/A | 100° C. reached time (s) | Improvement ratio | Evaluation |
|---|---|---|---|---|---|---|
| 25 | 1.65 | 1.05 | 0.636 | 366 | 1.03 | Unacceptable |
| 26 | 1.65 | 1.25 | 0.758 | 360 | 1.01 | Unacceptable |

TABLE 4-continued

| Sample No. | Thickness A (mm) | Length C (mm) | C/A | 100° C. reached time (s) | Improvement ratio | Evaluation |
|---|---|---|---|---|---|---|
| 27 | 1.65 | 1.45 | 0.879 | 356 | 1.00 | (Reference sample) |
| 28 | 1.65 | 1.65 | 1.000 | 338 | 0.95 | Good |
| 29 | 1.65 | 1.85 | 1.121 | 328 | 0.92 | Good |

It was confirmed that, as shown in Tables 3 and 4, the samples in which the length C is rendered equal to or greater than the thickness A can enhance the heat conduction performance further. Conceivably, the further enhanced heat conduction performance is attained because the straight surface has a portion where the straight surface is prevented from becoming high in temperature due to heat conducted from the ceramic insulator, etc., and the quantity of heat conducted from the ceramic insulator to the straight surface increases remarkably.

The results of the above-described test reveal that, in order to further enhance the heat conduction performance, the ignition plug is preferably configured to satisfy the relation C≥A.

Next, there were manufactured samples of the ignition plug in which a parallel portion having an outer circumferential surface extending parallel to the straight surface was formed on the base end of the leg portion, and the length L (along the axial direction) of the region where the distance between the straight surface and the outer circumferential surface of the ceramic insulator was 0.22 mm or less was set to different values by changing the length of the parallel portion along the axial line and the length C of the straight surface. The above-described heat conduction performance evaluation test was performed for the manufactured samples.

In the present test, for the samples in which the length C was set to 1.05 mm, the improvement ratio of each sample was calculated with the 100° C. reached time of Sample 25 in Table 4 (having the same structure as Sample 31 in Table 5) used as a reference. For the samples in which the length C was set to 1.65 mm, the improvement ratio of each sample was calculated with the 100° C. reached time of Sample 28 in Table 4 (having the same structure as Sample 41 in Table 6) used as a reference. For the samples in which the length C was set to 1.85 mm, the improvement ratio of each sample was calculated with the 100° C. reached time of Sample 29 in Table 4 (having the same structure as Sample 51 in Table 7) used as a reference.

In the present test, a sample whose improvement ratio was 0.97 or less was evaluated "good" because it can enhance the heat conduction performance more effectively. A sample whose improvement ratio was greater than 0.97 but not greater than 1.00 was evaluated "acceptable" because its heat conduction performance enhancing effect is slightly low. A sample whose improvement ratio was greater than 1.00 was evaluated "unacceptable" because its heat conduction performance enhancing effect is poor. Table 5 shows the test results of the samples in which the length C was set to 1.05 mm, Table 6 shows the test results of the samples in which the length C was set to 1.65 mm, and Table 7 shows the test results of the samples in which the length C was set to 1.85 mm.

TABLE 5

| Sample No. | Length C (mm) | Length of parallel portion (mm) | Length L (mm) | 100° C. reached time (s) | Improvement ratio | Evaluation |
|---|---|---|---|---|---|---|
| 30 | 1.05 | 1.4 | 1.00 | 370 | 1.01 | Unacceptable |
| 31 | 1.05 | 1.6 | 1.05 | 366 | 1.00 | (Reference sample) |
| 32 | 1.05 | 1.8 | 1.05 | 365 | 1.00 | Acceptable |
| 33 | 1.05 | 2.0 | 1.05 | 362 | 0.99 | Acceptable |
| 34 | 1.05 | 2.2 | 1.05 | 359 | 0.98 | Acceptable |

TABLE 6

| Sample No. | Length C (mm) | Length of parallel portion (mm) | Length L (mm) | 100° C. reached time (s) | Improvement ratio | Evaluation |
|---|---|---|---|---|---|---|
| 40 | 1.65 | 1.4 | 1.0 | 340 | 1.01 | Unacceptable |
| 41 | 1.65 | 1.6 | 1.2 | 338 | 1.00 | (Reference sample) |
| 42 | 1.65 | 1.8 | 1.4 | 333 | 0.99 | Acceptable |
| 43 | 1.65 | 2.0 | 1.6 | 325 | 0.96 | Good |
| 44 | 1.65 | 2.2 | 1.65 | 320 | 0.95 | Good |

TABLE 7

| Sample No. | Length C (mm) | Length of parallel portion (mm) | Length L (mm) | 100° C. reached time (s) | Improvement ratio | Evaluation |
|---|---|---|---|---|---|---|
| 50 | 1.85 | 1.4 | 1.0 | 333 | 1.02 | Unacceptable |
| 51 | 1.85 | 1.6 | 1.2 | 328 | 1.00 | (Reference sample) |
| 52 | 1.85 | 1.8 | 1.4 | 321 | 0.98 | Acceptable |
| 53 | 1.85 | 2.0 | 1.6 | 312 | 0.95 | Good |
| 54 | 1.85 | 2.2 | 1.8 | 310 | 0.95 | Good |

It was revealed that, as shown in Tables 5 through 7, the samples in which the length L (along the axial direction) of the region where the distance between the straight surface and the outer circumferential surface of the ceramic insulator is 0.22 mm or less is set to 1.66 mm greater can enhance the heat conduction performance further. Conceivably, the further enhanced heat conduction performance is attained for the following reason. Since the region where the distance between the straight surface and the outer circumferential surface of the ceramic insulator is 0.22 mm or less and heat is easily conducted from the ceramic insulator to the straight surface is sufficiently long, the heat of the ceramic insulator is conducted to the metallic shell more effectively.

The results of the above-described test reveal that, in order to further enhance the heat conduction performance, it is more preferred that the distance between the straight surface and the outer circumferential surface of the ceramic insulator be 0.22 mm or less within a region having an extension (length) of 1.66 mm or greater in the axial direction.

Figure 5:
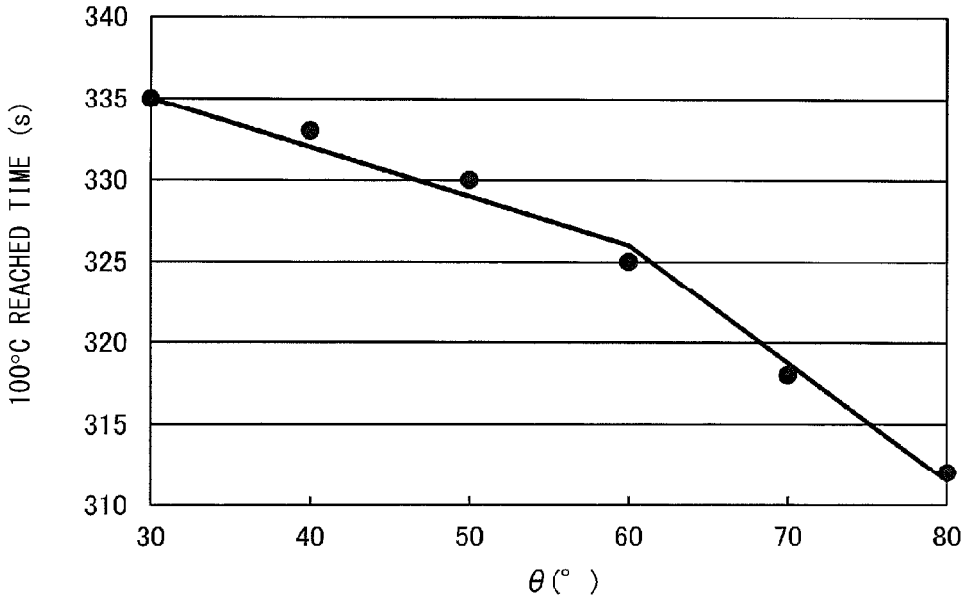
FIG. 5 is a graph showing the relation between the angle $\theta$ and 100° C. reached time.

Next, there were manufactured samples of the ignition plug in which the acute angle θ (°) between the outline of the forward-end-side surface of the protrusion and a straight line orthogonal to the axial line on a cross section including the axial line was set to different values. The above-described heat conduction performance evaluation test was performed for each sample. FIG. 5 shows a graph representing the relation between the angle θ and the 100° C. reached time. Notably, in each sample, the thickness A was set to 1.65 mm, the length C was set to 1.65 mm, and the length L was set to 1.66 mm.

FIG. 5 shows that, by setting the angle θ to 60° or greater, the 100° C. reached time becomes very short, and the heat of the ceramic insulator is conducted to the metallic shell quite effectively. Conceivably, this effect is attained because a large area of the forward-end-side surface is located near the ceramic insulator, and the heat of the ceramic insulator is easily conducted to the forward-end-side surface.

The results of the above-described test reveal that, in order to further enhance the heat conduction performance, it is more preferred that the angle θ be set to 60° or greater.

The present invention is not limited to the above-described embodiment, but may be embodied, for example, as follows. Of course, applications and modifications other than those described below are also possible.

(a) In the embodiment described above, the engagement portion 14 is indirectly engaged with the receiving surface 21A via the sheet packing 22. However, the engagement portion 14 may be directly engaged with the receiving surface 21A.

(b) In the embodiment described above, the ground electrode 27 is joined to the forward end portion 26 of the metallic shell 3. However, the present invention is also applicable to the case where a portion of a metallic shell (or a portion of an end metal welded beforehand to the metallic shell) is cut to form a ground electrode (refer to, for example, Japanese Patent Application Laid-Open (kokai) No. 2006-236906).

(c) In the embodiment described above, the tool engagement portion 19 has a hexagonal cross section. However, the shape of the tool engagement portion 19 is not limited thereto. For example, the tool engagement portion 19 may have a Bi-HEX (modified dodecagonal) shape [ISO22977:2005(E)] or the like.

Description Of Reference Numerals

1: ignition plug, 2: ceramic insulator (insulator), 3: metallic shell, 4: axial hole, 5: center electrode, 12: intermediate trunk portion, 14: engagement portion, 15: screw portion, 16: seating portion, 17: tube portion, 21: protrusion, 21A: receiving surface, 21B: straight surface, 21C: forward-end-side surface, CL1: axial line.

Having described the invention, the following is claimed:

1. An ignition plug comprising:

a tubular insulator having an axial hole extending in a direction of an axial line;

a center electrode inserted into a forward end portion of the axial hole; and a metallic shell provided around the insulator and having a protrusion protruding radially inward, wherein the insulator has an engagement portion which is engaged directly or indirectly with a receiving surface of the protrusion which is a rear-end-side surface thereof, and an intermediate trunk portion extending rearward from a rear end of the engagement portion, the metallic shell has, on its outer circumference, an attachment screw portion located on a radially outer side of the protrusion, a seating portion located rearward of the screw portion and projecting radially outward, and a tube portion located between the screw portion and the seating portion, the tube portion being located on the radially outer side of the intermediate trunk portion and having a diameter smaller than that of the seating portion, the screw portion has a screw diameter of 10 mm or less; and a relation $A \leq 1.70$ and a relation $B \geq 1.20$ are satisfied, where A is a thickness (mm) of the metallic shell along a direction which passes through a center of the receiving surface and is orthogonal to the axial line on a cross section including the axial line, and B is a minimum thickness (mm) of the metallic shell at the tube portion along the direction orthogonal to the axial line.

2. An ignition plug according to claim 1, wherein the protrusion has a straight surface extending forward from a forward end of the receiving surface and having a fixed inner diameter; and a relation $C \geq A$ is satisfied, where C is a length (mm) of the straight surface along the axial line.

3. An ignition plug according to claim 1 or 2, wherein the protrusion has a straight surface extending forward from a forward end of the receiving surface and having a fixed inner diameter; and a distance between the straight surface and an outer circumferential surface of the insulator is 0.22 mm or less within a region having an extension of 1.6 mm or greater in the direction of the axial line.

4. An ignition plug according to any one of claim 1 or 2, wherein the protrusion has a tapered forward-end-side surface whose diameter decreases toward the forward end side in the direction of the axial line; and a relation $\theta \geq 60$ is satisfied, where θ is an acute angle (°) formed between an outline of the forward-end-side surface and a straight line perpendicularly intersecting the axial line on the cross section including the axial line.

5. An ignition plug according to claim 3, wherein the protrusion has a tapered forward-end-side surface whose diameter decreases toward the forward end side in the direction of the axial line; and a relation $\theta \geq 60$ is satisfied, where θ is an acute angle (°) formed between an outline of the forward-end-side surface and a straight line perpendicularly intersecting the axial line on the cross section including the axial line.

* * * * *